US010041289B2

(12) United States Patent
Collins et al.

(10) Patent No.: US 10,041,289 B2
(45) Date of Patent: Aug. 7, 2018

(54) INTERFACE BETWEEN A FLOOR PANEL AND A PANEL TRACK

(71) Applicant: Innovative Building Technologies, LLC, Seattle, WA (US)

(72) Inventors: Arlan Collins, Seattle, WA (US); Mark Woerman, Seattle, WA (US)

(73) Assignee: INNOVATIVE BUILDING TECHNOLOGIES, LLC, Seattle, WA (US)

( * ) Notice: Subject to any disclaimer, the term of this patent is extended or adjusted under 35 U.S.C. 154(b) by 34 days.

(21) Appl. No.: 14/779,831

(22) PCT Filed: Aug. 30, 2014

(86) PCT No.: PCT/US2014/053615
§ 371 (c)(1),
(2) Date: Sep. 24, 2015

(87) PCT Pub. No.: WO2016/032539
PCT Pub. Date: Mar. 3, 2016

(65) Prior Publication Data

US 2016/0290030 A1 Oct. 6, 2016

(51) Int. Cl.
*E06B 1/70* (2006.01)
*E05D 15/06* (2006.01)
(Continued)

(52) U.S. Cl.
CPC ..... *E06B 1/70* (2013.01); *E04B 5/36* (2013.01); *E04B 5/40* (2013.01); *E05D 15/0686* (2013.01);
(Continued)

(58) Field of Classification Search
CPC ..... E04B 5/36; E04B 5/40; E04B 2005/322; E05D 15/0686; E06B 1/70; E06B 3/46; E06B 3/4636
See application file for complete search history.

(56) References Cited

U.S. PATENT DOCUMENTS 1,168,556 A 1/1916 Robinson et al.
1,876,528 A 9/1932 Walters
(Continued)

FOREIGN PATENT DOCUMENTS

AU 2005200682 5/2005
AU 2012211472 2/2014
(Continued)

OTHER PUBLICATIONS

US 8,701,371, 04/2014, Collins et al. (withdrawn)
(Continued)

*Primary Examiner* — James M Ference

(57) ABSTRACT

An example apparatus is disclosed that may include a bottom plate, a front plate coupled along a bottom edge to a front edge of the bottom plate, a top plate coupled along a front edge to a top edge of the front plate such that a channel is formed between the bottom and top plates, a vertical stopping plate coupled along a lower edge to a back edge of the top plate, a hat channel coupled to an inner surface of the channel, wherein the hat channel runs perpendicular to a length of the channel, and a embedding material inside the hat channel, wherein the embedding material is adjacent to a bottom surface of the top plate. An example method is disclosed that may include coupling a closure piece to a floor panel and coupling a track to the closure piece.

14 Claims, 9 Drawing Sheets

(51) Int. Cl.

| | |
|---|---|
| ***E04B 5/40*** | (2006.01) |
| ***E06B 3/46*** | (2006.01) |
| ***E04B 5/36*** | (2006.01) |
| *E04B 5/32* | (2006.01) |

(52) U.S. Cl.
CPC ..... *E06B 3/46* (2013.01); *E06B 3/4636* (2013.01); *E04B 2005/322* (2013.01)

(56) References Cited

U.S. PATENT DOCUMENTS 1,883,376 A 10/1932 Meier et al.
2,160,161 A 5/1939 Marsh
2,419,319 A 4/1947 Lankton
2,495,862 A 1/1950 Osborn
2,562,050 A 7/1951 Lankton
2,686,420 A 8/1954 Youtz
2,722,724 A * 11/1955 Miller ..... E06B 1/70 49/467
2,871,544 A 2/1959 Youtz
2,871,997 A 2/1959 Simpson et al.
3,017,723 A 1/1962 Von Heidenstam
3,052,449 A 9/1962 Long et al.
3,053,015 A 9/1962 Graham
3,053,509 A 9/1962 Haupt et al.
3,065,575 A * 11/1962 Ray ..... E04B 2/58 52/241
3,079,652 A * 3/1963 Wahlfeld ..... E06B 1/70 49/469
3,184,893 A 5/1965 Booth
3,221,454 A 12/1965 Togni
3,235,917 A * 2/1966 Skubic ..... E06B 1/70 206/231
3,236,014 A 2/1966 Edgar
3,245,183 A 4/1966 Tessin
3,281,172 A 10/1966 Kuehl
3,315,424 A * 4/1967 Smith ..... E04B 1/161 264/35
3,388,512 A 6/1968 Newman
3,392,497 A * 7/1968 Cushman ..... E04B 1/6183 52/241
3,411,252 A 11/1968 Boyle, Jr.
3,460,302 A 8/1969 Cooper
3,490,191 A 1/1970 Ekblom
3,579,935 A 5/1971 Regan et al.
3,590,393 A 7/1971 Hollander
3,594,965 A 7/1971 Saether
3,604,174 A 9/1971 Nelson, Jr.
3,608,258 A * 9/1971 Spratt ..... E04B 2/7448 52/241
3,614,803 A * 10/1971 Matthews ..... E05D 15/0608 16/94 R
3,638,380 A 2/1972 Perri
3,707,165 A 12/1972 Stahl
3,713,265 A 1/1973 Wysocki et al.
3,721,056 A 3/1973 Toan
3,722,169 A 3/1973 Boehmig
3,727,753 A 4/1973 Starr
3,742,666 A 7/1973 Antoniou
3,751,864 A 8/1973 Berger et al.
3,755,974 A 9/1973 Berman
3,762,115 A 10/1973 McCaul, III
3,766,574 A 10/1973 Smid, Jr.
3,821,818 A 7/1974 Alosi
3,823,520 A 7/1974 Ohta et al.
3,845,601 A 11/1974 Kostecky
3,853,452 A 12/1974 Delmonte
3,906,686 A 9/1975 Dillon
3,921,362 A 11/1975 Cortina
3,926,486 A 12/1975 Sasnett
3,971,605 A 7/1976 Sasnett
3,974,618 A 8/1976 Cortina
4,038,796 A * 8/1977 Eckel ..... E04B 2/721 52/220.7
4,050,215 A 9/1977 Fisher
4,059,936 A * 11/1977 Lukens ..... E04B 7/22 52/310
4,078,345 A 3/1978 Piazzalunga
4,107,886 A 8/1978 Ray
4,112,173 A 9/1978 Roudebush et al.
4,142,255 A 3/1979 Togni
4,171,545 A 10/1979 Kann
4,176,504 A * 12/1979 Huggins ..... E04B 1/68 52/264
4,178,343 A 12/1979 Rojo, Jr.
4,206,162 A 6/1980 Vanderklaauw
4,214,413 A * 7/1980 Gonzalez Espinosa de Los Monteros ..... E04B 1/20 52/236.1
4,221,441 A 9/1980 Bain
4,226,061 A 10/1980 Day, Jr.
4,251,974 A 2/1981 Vanderklaauw
4,280,307 A 7/1981 Griffin
4,314,430 A 2/1982 Farrington
4,325,205 A 4/1982 Salim
4,327,529 A 5/1982 Bigelow, Jr.
4,341,052 A 7/1982 Douglass, Jr.
4,361,994 A 12/1982 Carver
4,389,831 A 6/1983 Baumann
4,397,127 A 8/1983 Mieyal
4,435,927 A 3/1984 Umezu et al.
4,441,286 A 4/1984 Skvaril
4,447,987 A * 5/1984 Lesosky ..... E06B 1/70 49/468
4,447,996 A 5/1984 Maurer, Jr.
4,477,934 A 10/1984 Salminen
4,507,901 A 4/1985 Carroll
4,513,545 A 4/1985 Hopkins, Jr.
4,528,793 A 7/1985 Johnson
4,646,495 A 3/1987 Chalik
4,655,011 A 4/1987 Borges
4,688,750 A * 8/1987 Teague ..... A47B 96/1416 248/243
4,757,663 A 7/1988 Kuhr
4,856,244 A 8/1989 Clapp
4,862,663 A * 9/1989 Krieger ..... E04B 9/001 52/309.16
4,893,435 A * 1/1990 Shalit ..... E05F 15/643 49/139
4,918,897 A * 4/1990 Luedtke ..... E04B 1/16 52/291
4,919,164 A 4/1990 Barenburg
4,974,366 A * 12/1990 Tizzoni ..... E06B 1/325 49/399
4,991,368 A 2/1991 Amstutz
5,010,690 A * 4/1991 Geoffrey ..... E06B 1/70 49/468
5,036,638 A * 8/1991 Kurtz, Jr. ..... E04B 1/14 52/264
5,076,310 A 12/1991 Barenburg
5,079,890 A 1/1992 Kubik
5,127,203 A 7/1992 Paquette
5,154,029 A * 10/1992 Sturgeon ..... E06B 7/14 52/235
5,185,971 A * 2/1993 Johnson, Jr. ..... A47B 57/408 211/94.01
5,205,091 A 4/1993 Brown
5,212,921 A * 5/1993 Unruh ..... E06B 1/70 49/504
5,233,810 A 8/1993 Jennings
5,307,600 A 5/1994 Simon, Jr.
5,359,820 A 11/1994 McKay
5,361,556 A 11/1994 Menchetti
5,402,612 A 4/1995 diGirolamo et al.
5,412,913 A 5/1995 Daniels et al.
5,426,894 A * 6/1995 Headrick ..... E06B 1/70 49/467
5,459,966 A 10/1995 Suarez
5,471,804 A 12/1995 Winter, IV
5,493,838 A 2/1996 Ross
5,509,242 A 4/1996 Rechsteiner et al.
5,519,971 A 5/1996 Ramirez
5,528,877 A 6/1996 Franklin

(56) References Cited

U.S. PATENT DOCUMENTS 5,584,142 A * 12/1996 Spiess ..... E05D 15/0656 49/409
5,592,796 A 1/1997 Landers
5,611,173 A * 3/1997 Headrick ..... E06B 1/70 118/504
5,628,158 A 5/1997 Porter
5,640,824 A * 6/1997 Johnson ..... E04B 7/22 52/284
5,660,017 A 8/1997 Houghton
5,678,384 A 10/1997 Maze
5,697,189 A 12/1997 Miller
5,699,643 A 12/1997 Kinard
5,706,607 A * 1/1998 Frey ..... E06B 1/70 49/469
5,724,773 A 3/1998 Hall
5,746,034 A * 5/1998 Luchetti ..... A47B 57/425 52/220.7
5,755,982 A 5/1998 Strickland
5,850,686 A 12/1998 Mertes
5,867,964 A 2/1999 Perrin
5,870,867 A 2/1999 Mitchell
5,921,041 A 7/1999 Egri, II
5,987,841 A 11/1999 Campo
5,992,109 A * 11/1999 Jonker ..... E04B 2/7448 52/126.4
5,997,792 A 12/1999 Gordon
6,000,194 A 12/1999 Nakamura
6,055,787 A * 5/2000 Gerhaher ..... E04F 13/0826 52/506.06
6,073,401 A * 6/2000 Iri ..... E04B 1/3483 52/236.3
6,073,413 A 6/2000 Tongiatama
6,076,319 A 6/2000 Hendershot
6,086,350 A 7/2000 Del Monte
6,154,774 A 11/2000 Furlong
6,170,214 B1 * 1/2001 Treister ..... E04F 13/0808 52/235
6,243,993 B1 6/2001 Swensson
6,244,002 B1 * 6/2001 Martin ..... E04B 2/7427 52/220.7
6,244,008 B1 6/2001 Miller
6,260,329 B1 7/2001 Mills
6,289,646 B1 * 9/2001 Watanabe ..... E04F 13/083 52/235
6,301,838 B1 10/2001 Hall
6,308,465 B1 10/2001 Galloway et al.
6,308,491 B1 10/2001 Porter
6,340,508 B1 1/2002 Frommelt
6,371,188 B1 * 4/2002 Baczuk ..... E06B 1/70 160/92
6,393,774 B1 5/2002 Fisher
6,430,883 B1 * 8/2002 Paz ..... A47F 5/105 52/235
6,446,396 B1 9/2002 Marangoni et al.
6,481,172 B1 11/2002 Porter
6,484,460 B2 11/2002 VanHaitsma
6,625,937 B1 9/2003 Parker
6,651,393 B2 11/2003 Don
6,729,094 B1 5/2004 Spencer et al.
6,748,709 B1 * 6/2004 Sherman ..... E04B 2/96 52/235
6,837,013 B2 1/2005 Foderberg et al.
6,922,960 B2 8/2005 Sataka
7,007,343 B2 * 3/2006 Weiland ..... E05D 15/0686 16/102
7,059,017 B1 * 6/2006 Rosko ..... E05D 15/0665 16/96 R
7,143,555 B2 12/2006 Miller
RE39,462 E * 1/2007 Brady ..... E04B 2/825 403/230
7,389,620 B1 * 6/2008 McManus ..... E04B 5/23 52/326
7,395,999 B2 7/2008 Walpole
7,444,793 B2 11/2008 Raftery et al.
7,467,469 B2 12/2008 Wall
7,484,329 B2 2/2009 Levy
7,484,339 B2 2/2009 Fiehler
7,493,729 B1 * 2/2009 Semmes ..... E04B 1/34315 52/198
7,574,837 B2 8/2009 Hagen, Jr. et al.
7,658,045 B2 2/2010 Elliott et al.
7,676,998 B2 3/2010 Lessard
7,694,462 B2 4/2010 O'Callaghan
7,721,491 B2 5/2010 Appel
7,748,193 B2 7/2010 Knigge et al.
7,908,810 B2 3/2011 Payne, Jr. et al.
7,921,965 B1 4/2011 Surace
7,966,778 B2 6/2011 Klein
8,051,623 B2 * 11/2011 Loyd ..... E04F 13/0803 52/235
8,096,084 B2 * 1/2012 Studebaker ..... E04B 1/003 52/250
8,109,058 B2 2/2012 Miller
8,166,716 B2 * 5/2012 Macdonald ..... E04F 13/0826 52/235
8,234,827 B1 * 8/2012 Schroeder, Sr. ..... E04B 1/24 52/334
8,234,833 B2 8/2012 Miller
8,251,175 B1 8/2012 Englert et al.
8,276,328 B2 10/2012 Pepin
8,322,086 B2 12/2012 Weber
8,359,808 B2 1/2013 Stephens, Jr.
8,424,251 B2 4/2013 Tinianov
8,490,349 B2 7/2013 Lutzner et al.
8,505,259 B1 8/2013 Degtyarev
8,539,732 B2 9/2013 Leahy
8,555,581 B2 10/2013 Amend
8,555,589 B2 10/2013 Semmens et al.
8,621,806 B2 1/2014 Studebaker et al.
8,733,046 B2 5/2014 Naidoo
8,769,891 B2 7/2014 Kelly
8,833,025 B2 * 9/2014 Krause ..... E04F 13/0828 52/235
8,950,132 B2 2/2015 Collins et al.
8,978,324 B2 3/2015 Collins et al.
8,997,424 B1 * 4/2015 Miller ..... E04B 1/08 52/243
9,027,307 B2 5/2015 Collins et al.
9,382,709 B2 * 7/2016 Collins
2002/0059763 A1 5/2002 Wong
2002/0170243 A1 * 11/2002 Don ..... E04B 1/3483 52/79.7
2003/0005653 A1 1/2003 Sataka
2003/0056445 A1 * 3/2003 Cox ..... E04B 5/10 52/62
2003/0084629 A1 * 5/2003 Strickland ..... E04B 5/32 52/289
2003/0101680 A1 6/2003 Lee
2003/0140571 A1 7/2003 Muha et al.
2003/0167712 A1 9/2003 Robertson
2003/0200706 A1 10/2003 Kahan et al.
2003/0221381 A1 * 12/2003 Ting ..... E06B 1/02 52/204.1
2004/0065036 A1 * 4/2004 Capozzo ..... E04B 9/0478 52/506.03
2004/0103596 A1 6/2004 Don
2005/0081484 A1 4/2005 Yland
2005/0108957 A1 5/2005 Quesada
2005/0188632 A1 9/2005 Rosen
2005/0198919 A1 9/2005 Hester, Jr.
2005/0204697 A1 * 9/2005 Rue ..... E04B 1/0023 52/782.1
2005/0204699 A1 * 9/2005 Rue ..... E04C 2/22 52/794.1
2005/0210764 A1 9/2005 Foucher et al.
2005/0210798 A1 9/2005 Burg et al.
2005/0235571 A1 * 10/2005 Ewing ..... E05C 7/06 49/410
2005/0235581 A1 10/2005 Cohen
2005/0247013 A1 11/2005 Walpole

(56) References Cited

U.S. PATENT DOCUMENTS

2005/0262771 A1* 12/2005 Gorman ..... E06B 7/14 49/408
2006/0021289 A1 2/2006 Elmer
2006/0070321 A1 4/2006 Au
2006/0096202 A1 5/2006 Delzotto
2006/0117689 A1 6/2006 Onken et al.
2006/0137293 A1* 6/2006 Klein ..... E04B 2/7411 52/782.1
2006/0143856 A1 7/2006 Rosko et al.
2006/0150521 A1* 7/2006 Henry ..... E06B 1/70 49/471
2006/0179764 A1 8/2006 Ito
2006/0248825 A1 11/2006 Garringer
2007/0000198 A1* 1/2007 Payne, Jr. ..... E04B 5/40 52/414
2007/0074464 A1 4/2007 Eldridge
2007/0107349 A1 5/2007 Erker
2007/0157539 A1 7/2007 Knigge et al.
2007/0163197 A1 7/2007 Payne et al.
2007/0209306 A1 9/2007 Andrews et al.
2007/0234657 A1* 10/2007 Speyer ..... E06B 7/23 52/207
2007/0283640 A1* 12/2007 Shivak ..... E04B 2/7455 52/207
2007/0294954 A1 12/2007 Barrett
2008/0000177 A1* 1/2008 Siu ..... E04B 1/24 52/319
2008/0057290 A1 3/2008 Guevara et al.
2008/0098676 A1* 5/2008 Hutchens ..... B28B 7/0026 52/281
2008/0104901 A1 5/2008 Olvera
2008/0168741 A1 7/2008 Gilgan
2008/0178542 A1 7/2008 Williams
2008/0202048 A1 8/2008 Miller et al.
2008/0222981 A1* 9/2008 De Gobbi ..... E04B 1/41 52/235
2008/0229669 A1* 9/2008 Abdollahzadeh ..... E06B 1/70 49/468
2008/0282626 A1 11/2008 Powers, Jr.
2008/0289265 A1 11/2008 Lessard
2008/0295450 A1 12/2008 Yogev
2009/0031652 A1* 2/2009 Ortega Gatalan .... E04F 13/081 52/235
2009/0038764 A1 2/2009 Pilz
2009/0077916 A1 3/2009 Scuderi et al.
2009/0090074 A1* 4/2009 Klein ..... E04B 2/7457 52/232
2009/0100760 A1* 4/2009 Ewing ..... E05B 65/0876 49/410
2009/0100769 A1 4/2009 Barrett
2009/0107065 A1* 4/2009 LeBlang ..... E04B 1/165 52/252
2009/0113820 A1 5/2009 Deans
2009/0134287 A1 5/2009 Klosowski
2009/0165399 A1 7/2009 Campos
2009/0188192 A1* 7/2009 Studebaker ..... F16B 5/0275 52/321
2009/0188193 A1* 7/2009 Studebaker ..... E04B 5/40 52/321
2009/0205277 A1 8/2009 Gibson
2009/0293395 A1 12/2009 Porter
2009/0313931 A1* 12/2009 Porter ..... B32B 5/18 52/309.4
2010/0064590 A1* 3/2010 Jones ..... E05D 15/0656 49/469
2010/0064601 A1 3/2010 Napier
2010/0146874 A1 6/2010 Brown
2010/0186313 A1 7/2010 Stanford et al.
2010/0212255 A1* 8/2010 Lesoine ..... E04F 13/0889 52/745.21
2010/0218443 A1* 9/2010 Studebaker ..... E04B 5/29 52/236.9
2010/0229472 A1 9/2010 Malpas
2010/0235206 A1 9/2010 Miller et al.
2010/0263308 A1 10/2010 Olvera
2010/0275544 A1* 11/2010 Studebaker ..... E04B 5/40 52/582.1
2010/0325971 A1 12/2010 Leahy
2010/0325989 A1 12/2010 Leahy
2011/0023381 A1 2/2011 Weber
2011/0041411 A1* 2/2011 Aragon ..... E06B 1/04 49/478.1
2011/0056147 A1 3/2011 Beaudet
2011/0113709 A1 5/2011 Pilz
2011/0154766 A1* 6/2011 Kralic ..... E04B 5/40 52/415
2011/0162167 A1* 7/2011 Blais ..... E06B 9/52 16/91
2011/0219720 A1* 9/2011 Strickland ..... E04B 1/24 52/655.1
2011/0247281 A1 10/2011 Pilz et al.
2011/0268916 A1 11/2011 Pardue, Jr.
2011/0296769 A1 12/2011 Collins et al.
2011/0296778 A1 12/2011 Collins et al.
2011/0296789 A1* 12/2011 Collins ..... E04B 1/24 52/741.4
2011/0300386 A1 12/2011 Pardue, Jr.
2012/0151869 A1 6/2012 Miller
2012/0167505 A1* 7/2012 Krause ..... E04F 13/0817 52/302.1
2012/0186174 A1* 7/2012 LeBlang ..... E04B 1/165 52/220.1
2012/0210658 A1* 8/2012 Logan ..... E04B 2/88 52/173.1
2012/0297712 A1* 11/2012 Lutzner ..... E06B 7/14 52/302.1
2013/0025222 A1* 1/2013 Mueller ..... E04H 9/02 52/293.3
2013/0036688 A1 2/2013 Gosain
2013/0067832 A1 3/2013 Collins et al.
2013/0111840 A1* 5/2013 Bordener ..... E04B 1/68 52/393
2013/0133277 A1 5/2013 Lewis
2014/0013678 A1* 1/2014 Deverini ..... B29C 44/1233 52/79.1
2014/0013695 A1 1/2014 Wolynski et al.
2014/0047780 A1 2/2014 Quinn et al.
2014/0059960 A1 3/2014 Cole
2014/0069035 A1 3/2014 Collins et al.
2014/0069040 A1 3/2014 Gibson
2014/0069050 A1 3/2014 Bolin
2014/0083046 A1 3/2014 Yang
2014/0130441 A1 5/2014 Sugihara et al.
2015/0096251 A1* 4/2015 McCandless ..... E04F 13/0807 52/404.3
2015/0211227 A1 7/2015 Collins et al.
2016/0290030 A1 10/2016 Collins et al.

FOREIGN PATENT DOCUMENTS

AU 2012211472 A1 2/2014
CN 02137279 3/2008
CN 102587693 A 7/2012
CN 202299241 U 7/2012
CN 102733511 A 10/2012
EP 1045078 10/2000
EP 1375804 A2 1/2004
EP 2128353 A1 12/2009
EP 2238872 A2 10/2010
EP 1739246 1/2011
EP 2281964 2/2011
GB 898905 6/1962
JP 52-015934 Y 4/1977
JP S53000014 Y2 1/1978
JP S5484112 U 6/1979
JP 57-158451 A 9/1982
JP H0310985 1/1991
JP H049373 Y2 3/1992
JP 07-052887 Y 12/1995
JP 2576409 Y 4/1998
JP 10234493 9/1998

(56) References Cited

FOREIGN PATENT DOCUMENTS

| | | | |
|---|---|---|---|
| JP | H10245918 | A | 9/1998 |
| JP | 2000144997 | | 5/2000 |
| JP | 3137760 | B2 | 2/2001 |
| JP | 2002364104 | A | 12/2002 |
| JP | 2008073434 | | 4/2008 |
| JP | 2008110104 | | 5/2008 |
| KR | 20060066931 | | 6/2006 |
| WO | 9107557 | A1 | 5/1991 |
| WO | 1997022770 | | 6/1997 |
| WO | 00/58583 | | 10/2000 |
| WO | 0058583 | | 10/2000 |
| WO | 0235029 | A1 | 5/2002 |
| WO | 2007059003 | | 5/2007 |
| WO | 2010/030060 | | 3/2010 |
| WO | 2010037938 | A2 | 4/2010 |
| WO | 2016032537 | A1 | 3/2016 |
| WO | 2016032538 | A1 | 3/2016 |
| WO | 2016032539 | A1 | 3/2016 |
| WO | 2016032540 | A1 | 3/2016 |
| WO | 2016033429 | A1 | 3/2016 |
| WO | 2016033525 | A1 | 3/2016 |

OTHER PUBLICATIONS

Chinese Office Action and Search Report dated Nov. 2, 2016 received in on 201480030914.0.
Emerging Trends in real estate, accessed on Sep. 15, 2016 at https://web.archive.org/web/20140813084823/http://pwc.com.au/industry/real-estate/assets/Real-Estate-2012-Europe-Jan12.pdf, pp. 60 (2012).
Insulspan Installation Guide, Installation Guide, pp. 58 (Apr. 25, 2008).
International Search Report and Written opinion for International Application No. PCT/US/2014/053613 dated Dec. 18, 2014, pp. 13.
International Search Report and Written opinion for International Application No. PCT/US/2014/053614 dated Dec. 18, 2014, pp. 11.
International Search Report and Written opinion for International Application No. PCT/US/2014/053615 dated Dec. 17, 2014, pp. 11.
International Search Report and Written opinion for International Application No. PCT/US/2014/053616 dated Dec. 17, 2014, pp. 9.
International Search Report and Written opinion for International Application No. PCT/US15/47536 dated Dec. 4, 2015, pp. 17.
International Search Report and Written opinion for International Application No. PCT/US2015/047383 dated Jan. 12, 2016, pp. 14.
International Search Report and Written Opinion for International Application No. PCT/US2011/001039 dated Oct. 5, 2011, pp. 14.
Final Office Action dated Apr. 15, 2014, in U.S. Appl. No. 14/077,565, Arlan Collins, filed Jun. 8, 2010.
Final Office Action dated Apr. 18, 2012, in U.S. Appl. No. 12/796,603, Arlan E. Collins, filed Jun. 8, 2010.
Final Office Action dated Apr. 18, 2012, in U.S. Appl. No. 13/155,319, Arlan Collins, filed Jun. 7, 2011.
Final Office Action dated May 9, 2013, in U.S. Appl. No. 13/155,319, Arlan Collins, filed Jun. 7, 2011.
Final Office Action dated May 11, 2012, in U.S. Appl. No. 12/796,625, Arlan Collins., filed Jun. 8, 2010.
Final Office Action dated May 6, 2014, in U.S. Appl. No. 12/796,603, Arlan E. Collins, filed Jun. 8, 2010.
Final Office Action dated Oct. 28, 2014, in U.S. Appl. No. 13/700,429, Arlan K Collins, filed Nov. 27, 2012.
Non Final Office Action dated Dec. 27, 2013, in U.S. Appl. No. 14/077,565, Arlan Collins, filed Jun. 8, 2010.
Non Final Office Action dated Jul. 18, 2013, in U.S. Appl. No. 12/796,625, Arlan Collins, filed Jun. 8, 2010.
Non Final Office Action dated Nov. 8, 2012, in U.S. Appl. No. 13/155,319, Arlan Collins, filed Jun. 7, 2011.
Non Final Office Action dated Oct. 11, 2011, in U.S. Appl. No. 12/796,625, Arlan Collins, filed Jun. 8, 2010.
Non Final Office Action dated Oct. 19, 2011, in U.S. Appl. No. 13/155,319, Arlan Collins, filed Jun. 7, 2011.
Non-Final Office Action dated Apr. 11, 2014, in U.S. Appl. No. 13/700,429, Arlan Collins, filed Nov. 27, 2012.
Non-Final Office Action dated Jul. 18, 2013, in U.S. Appl. No. 12/796,603, Arlan E. Collins, filed Jun. 8, 2010.
Non-Final Office Action dated Oct. 11, 2011, in U.S. Appl. No. 12/796,603, Arlan E. Collins, filed Jun. 8, 2010.
Notice of Allowance Action dated Jun. 9, 2014, in U.S. Appl. No. 12/796,625, Arlan Collins, filed Jun. 8, 2010.
Notice of Allowance Action dated Mar. 14, 2014, in U.S. Appl. No. 12/796,625, Arlan Collins, filed Jun. 8, 2010.
Notice of Allowance Action dated May 6, 2014, in U.S. Appl. No. 12/796,625, Arlan Collins, filed Jun. 8, 2010.
Notice of Allowance Action dated Nov. 15, 2013, in U.S. Appl. No. 12/796,625, Arlan Collins, filed Jun. 8, 2010.
Notice of Allowance dated Jan. 7, 2015, in U.S. Appl. No. 12/796,625, Arlan K Collins, filed Jun. 8, 2010.
Notice of Allowance dated Jul. 8, 2014, in U.S. Appl. No. 14/077,565, Arlan Collins, filed Jun. 8, 2010.
Notice of Allowance dated Nov. 6, 2014, in U.S. Appl. No. 12/796,603, Arlan K Collins, filed Jun. 8, 2010.
Notice of Allowance dated Nov. 13, 2014, in U.S. Appl. No. 14/077,565, Arlan K Collins, filed Nov. 12, 2013.
Notice of Allowance dated Sep. 12, 2014, in U.S. Appl. No. 12/796,625, Arlan K Collins, filed Jun. 8, 2010.
Notice of Allowance dated Sep. 23, 2014, in U.S. Appl. No. 12/796,603, Arlan K Collins, filed Jun. 8, 2010.
"Beam to column connection", TATA Steel, http://www.tatasteelconstruction.com/en/reference/teaching_resources/architectural_studio_reference/elements/connections/beam_to_column_connections, 2014.
"Emerging Trends in Real Estate 2012 Executive Summary", Urban Land Institute, Ch. 1, 2012, 3-13.
"How to Soundproof a Ceiling—Soundproofing Ceilings", http://www.soundproofingcompany.com/soundproofing-solutions/sound-proof-a-ceiling/, Apr. 2, 2014, 1-7.
"Structural Insulated Panel", Wikipedia, http://www.en.wikipedia.org//wiki/Structural_insulated_panel, May 30, 2014.
"Structural Insulated Panels", SIP Solutions, http://www.sipsolutions.com/content/structural-insulated-panels, Aug. 15, 2014.
"US Apartment & Condominium Construction Forecast 2003-2017", Statista, Inc.
Azari, et al., "Modular Prefabricated Residential Construction—Constraints and Opportunities", PNCCRE Technical Report #TR002, Aug. 2013, 90.
Borzouie, Jamaledin et al., "Seismic Assessment and Rehabilitation of Diaphragms", http://www.nosazimadares.ir/behsazi/15WCEE2012/URM/1/Roof.pdf, Dec. 31, 2011.
Framecad, "FC EW 1-12mm Fibre Cement Sheet + 9mm MgO Board Wall Assembly", 2013, 1.
Giles, et al., "Innovations in the Development of Industrially Designed and Manufactured Modular Concepts for Low-Energy, Multi-Story, High Density, Prefabricated Affordable Housing", Innovations in the Development of Industrially Designed and Manufactured Modular Concepts, Jun. 2006, 1-15.
Gonchar, "Paradigm Shift—Multistory Modular", Architectural Record, Oct. 2012, 144-148.
Kerin, et al., "National Apartment Market Report—2013", Marcus & Millichap, 2013, 1-9.
McIlwain "Housing in America—The Next Decade", Urban Land Institute, 2010, 1-28.
McIlwain, "The Rental Boost From Green Design", Urban Land, http://urbanland.uli.org/sustainability/the-rental-boost-from-green-design/, Jan. 4, 2012, 1-6.
Riusillo, M. A., "Lift Slab Construction: its History, Methodology, Economics, and Applications", Abstract, International Concrete Research & Information Portal, Jun. 1, 1988, pp. 59-68, vol. 107, Special Publication.
Shashaty, Andre, "Housing Demand", Sustainable Communities, Apr. 2011, 14-18.
"Severe Apartment Shortage Looms", Urban Land, http://urbanland.uli.org/capital-markets/nahb-orlando-severe-apartment-shortage-looms/, Jan. 13, 2011, 1-2.

(56) References Cited

OTHER PUBLICATIONS

Stiemer, S F., "Bolted Beam-Column Connections", http://faculty.philau.edu/pastorec/Tensile/bolted_beam_column_connections.pdf, Nov. 11, 2007, 1-16.
Supplementary European Search Report received for PCT 14891125.8-1604/3011122 dated Jul. 8, 2016.

* cited by examiner

INTERFACE BETWEEN A FLOOR PANEL AND A PANEL TRACK

CROSS-REFERENCE TO RELATED APPLICATION

This application is a U.S. National Stage filing under 35 U.S.C. § 371 of International Application No. PCT/US2014/053615, filed on Aug. 30, 2014. The disclosure of the International application is incorporated herein by reference in its entirety and for any purpose.

BACKGROUND

A building may include sliding doors or walls that open to the exterior of the building. The sliding doors or walls may be made of one or more movable panels. The panels may fit into a track to facilitate alignment and movement of the panels. The building may include an interior concrete floor. The sliding door or wall may further open to a concrete exterior surface, for example, a balcony or a patio. Installing the track for the sliding door or wall directly to the interior floor may cause a height difference between surfaces which may cause difficulties, for example difficulties for those with disabilities. The track may be a height that inhibits the ability of a wheelchair to cross the threshold. Installing the track directly to the exterior surface may incur similar difficulties. Furthermore, installing the track on a concrete surface may require additional labor and/or specialized fasteners.

SUMMARY

Techniques are generally described that include apparatuses, methods and systems that may allow easier installation for a sliding door and/or window track and may allow the track to be substantially level with a floor and/or other surface. Having the track substantially level with a floor and/or other surface may provide an interface at the track that is easier for people, carts, and/or wheelchairs to cross. The interface may further allow compliance with regulations for accessibility for the disabled. An example apparatus may include a bottom plate, a front plate coupled along a bottom edge to a front edge of the bottom plate, a top plate coupled along a front edge to a top edge of the front plate such that a channel may be formed between the bottom and top plates, a vertical stopping plate coupled along a lower edge to a back edge of the top plate, a hat channel coupled to an inner surface of the channel, wherein the hat channel may run perpendicular to a length of the channel, and a embedding material inside the hat channel, wherein the embedding material may be adjacent to a bottom surface of the top plate.

In some embodiments, the embedding material may comprise foam. In some embodiments, the foam may have a thickness of one inch.

In some embodiments, the bottom plate, front plate, and top plate may be coupled at right angles.

In some embodiments, the apparatus may further include a plurality of hat channels coupled to the inner surface of the channel. In some embodiments, the plurality of hat channels may be spaced at two foot intervals along the length of the channel.

In some embodiments, the bottom plate may further comprise openings configured to couple the bottom plate to a floor panel.

In some embodiments, the apparatus may further include a track coupled to the top plate. In some embodiments, the track may be coupled to the top plate by a fastener at least partially embedded in the embedding material.

An example method may include coupling a closure piece to a floor panel, wherein the floor panel may include a decking, pouring concrete over the decking and into the closure piece to form a concrete floor on the floor panel, coupling a track to an upper surface of the closure piece by attaching a fastener to the closure piece at a location where the closure piece encloses a portion of embedding material, wherein an upper surface of the track may be flush with an upper surface of the concrete floor.

In some embodiments, the closure piece may span a distance between the floor panel and a C-channel.

In some embodiments, the closure piece may span a distance between the floor panel and a balcony.

In some embodiments, the upper surface of the track may be less than a quarter of an inch higher than an upper surface of the balcony.

In some embodiments, the closure piece may include a stopping plate to prevent the concrete from flowing onto the upper surface of the closure piece.

In some embodiments, the floor panel may include at least one joist below the decking. In some embodiments, a portion of the closure piece may be between the joist and the decking of the floor panel. In some embodiments, the method may further comprise retracting the closure piece such that the portion of the closure piece between the joist and the decking of the floor panel may be under the decking, securing the floor panel to a C-channel, and extending the closure piece to span a distance between the floor panel and the C-channel before pouring the concrete.

An example system may include a floor panel, wherein the floor panel may include at least one joist and a deck, wherein the deck may form an upper surface of the floor panel. The system may further include a closure piece that may be coupled to the floor panel, wherein the closure piece may include a bottom plate, a front plate coupled along a bottom edge to a front edge of the bottom plate, a top plate coupled along a front edge to a top edge of the front plate, a vertical stopping plate coupled along a lower edge to a back edge of the top plate, a hat channel between the top plate and the bottom plate, wherein the hat channel may run perpendicular to a length of the closure piece, and an embedding material inside the hat channel, wherein the embedding material may be adjacent to a bottom surface of the top plate. The system may further include a track that may be coupled to an upper surface of the top plate of the closure piece.

In some embodiments, the system may further include a concrete floor poured over the deck of the floor panel and between the top plate and bottom plate of the closure piece. In some embodiments, the concrete floor may be level with an upper edge of the vertical stopping plate.

In some embodiments, the system may further comprise a balcony adjacent to the front plate of the closure piece.

In some embodiments, the closure piece may be coupled to the floor panel wherein the bottom plate is between the at least one joist and the deck.

In some embodiments, the closure piece may be slidably coupled to the floor panel.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1A:
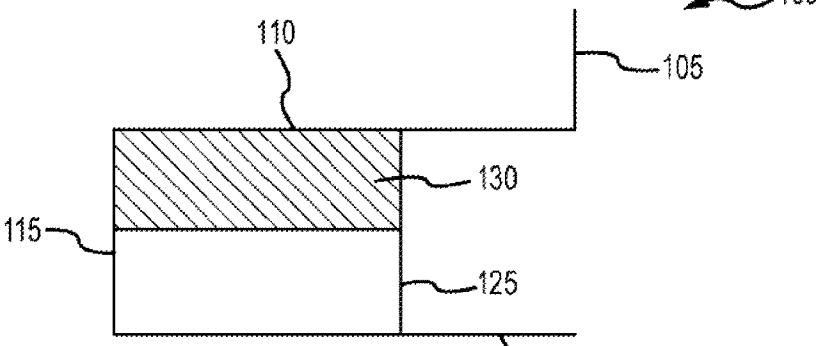
FIG. 1A is a schematic illustration of a side view of an example closure piece.

all arranged in accordance with at least some embodiments of the present disclosure.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are implicitly contemplated herein.

This disclosure is drawn, inter alia, to methods, systems, products, devices, and/or apparatuses that may allow easier installation for a sliding door and/or window track and may allow the track to be substantially level with a floor and/or other surface. Having the track substantially level with a floor and/or other surface may provide an interface at the track that is easier for people, carts, and/or wheelchairs to cross. The interface may further allow compliance with regulations for accessibility for the disabled. This disclosure is drawn, inter alia, to methods, systems, products, devices, and/or apparatuses generally related to an apparatus that may include a bottom plate, a front plate coupled along a bottom edge to a front edge of the bottom plate, a top plate coupled along a front edge to a top edge of the front plate such that a channel is formed between the bottom and top plates, a vertical stopping plate coupled along a lower edge to a back edge of the top plate, a hat channel coupled to an inner surface of the channel, wherein the hat channel runs perpendicular to a length of the channel, and a embedding material inside the hat channel, wherein the embedding material is adjacent to a bottom surface of the top plate.

In some embodiments, a form may be used to direct uncured concrete, foam, or other material into a desired shape or space. In some embodiments, it may act as a mold. In some embodiments, a form may be designed to be used a functional piece of a structure after the material has cured. A form may be configured to act as the edge of a floor and span a gap between the floor and another surface or structure. That is, the form may close the gap between the two. The form may act as a closure piece in some embodiments.

The closure piece may be an interface between the floor and another surface or structure—e.g. a patio or balcony. In some embodiments, sliding doors and/or walls may be desired at the interface. The sliding doors and/or walls may slide in a track. In some embodiments, the closure piece may be configured to allow the installation of the track at the interface.

In some embodiments, the closure piece may include embedding materials that may allow the track to be installed without drilling through concrete. In some embodiments, the embedding materials may block the concrete from entering portions of the closure piece. In some embodiments, the embedding materials may be configured to hold fasteners securely. Even after the concrete has cured, in some embodiments, the track may be installed by securing fasteners into the embedding materials. This may allow for easier installation of the track, and may reduce the risk of damaging the concrete floor in some embodiments.

In some embodiments, the closure piece may be configured to look like a hat channel with one of its side flanges removed or straightened. In some embodiments, the closure piece may be laid on its side such that the remaining flange is pointing upwards. The flange may act as a vertical stopping plate to prevent concrete and/or other uncured material from flowing over the closure piece. The closure piece may further include smaller hat channels inside the closure piece. The hat channels may run perpendicular to the length of the closure piece. The hat channels may secure an embedding material such as polystyrene foam in the closure piece. When concrete is poured into the closure piece, it may substantially fill the closure piece except where the embedding material is secured. A track may then be placed on top of the closure piece against the vertical stopping plate and fastened to the closure piece at the locations of the embedding material.

In some embodiments, the material composition of the floor panel and panel track interface system may be predominantly steel. In some embodiments it may be predominately aluminum. In still other embodiments, the system components may be made from a variety of building suitable materials ranging from metals and/or metal alloys, to wood and wood polymer composites (WPC), wood based products (lignin), other organic building materials (bamboo) to organic polymers (plastics), to hybrid materials, or earthen materials such as ceramics. In some embodiments cement or other pourable or moldable building materials may also be used. In other embodiments, any combination of suitable building material may be combined by using one building material for some elements of the system and other building materials for other elements of the system. Selection of any material may be made from a reference of material options (such as those provided for in the International Building Code), or selected based on the knowledge of those of ordinary skill in the art when determining load bearing requirements for the structures to be built. Larger and/or taller structures may have greater physical strength requirements than smaller and/or shorter buildings. Adjustments in building materials to accommodate size of structure, load and environmental stresses can determine optimal economical choices of building materials used for all components in the system described herein. Availability of various building materials in different parts of the world may also affect selection of materials for building the system described herein. Adoption of the International Building Code or similar code may also affect choice of materials.

Any reference herein to "metal" includes any construction grade metals or metal alloys as may be suitable for fabrication and/or construction of the system and components described herein. Any reference to "wood" includes wood, wood laminated products, wood pressed products, wood polymer composites (WPCs), bamboo or bamboo related products, lignin products and any plant derived product, whether chemically treated, refined, processed or simply harvested from a plant. Any reference herein to "concrete" includes any construction grade curable composite that includes cement, water, and a granular aggregate. Granular aggregates may include sand, gravel, polymers, ash and/or other minerals.

Turning to now to the figures, FIG. 1A shows a schematic illustration of a side view of an example closure piece 100, arranged in accordance with at least some embodiments described herein. FIG. 1A shows a stopping plate 105 coupled to a top plate 110, which is coupled to a front plate 115, and the front plate 115 is coupled to a bottom plate 120. The closure piece 100 further includes a hat channel 125 and an embedding material 130 within the hat channel 125. The various components described in FIG. 1A are merely embodiments, and other variations, including eliminating components, combining components, and substituting components are all contemplated.

The plates 105, 110, 115, 120 and the hat channel 125 may be implemented using a metallic material such as aluminum or steel in some embodiments. In some embodiments, the plates 105, 110, 115, 120 and the hat channel 125 may be implemented using 18-20 gauge cold-rolled steel. In some embodiments, the steel may have a baked-on painted finish. Other materials may also be used for the plates and/or hat channel such as polymer or polymer composite materials. In some embodiments, a different material may be used for the plates 105, 110, 115, 120 than the hat channel 125.

The plates 105, 110, 115, 120 may be coupled such that they form substantially right angles. As used herein, a substantially right angle refers to the angle formed between two elements that is 90 degrees plus or minus up to about 15 degrees. Plates 110, 115, 120 may define a channel that runs a length of the plates 110, 115, 120. In some embodiments, the top plate 110 may be nine inches wide from the front plate 115 to the vertical stopping plate 105. The top plate 110 may have different widths in some embodiments. In some embodiments, the width of the top plate may be determined, at least in part, by the width of a track to be installed. In some embodiments, the vertical stopping plate 105 may extend two inches above the top plate 110. In some embodiments, the vertical stopping plate 105 may extend three inches above the top plate. Other heights for the vertical stopping plate 105 may be possible. In some embodiments, the height for the vertical stopping plate may be determined, at least in part, by the height of the track to be installed. In some embodiments, the bottom plate 120 may extend from the front plate 115 to a distance beyond the vertical stopping plate 105. The bottom plate may further include openings (not shown) to couple the closure piece to a floor panel (not shown in FIG. 1A).

The hat channel 125 may be configured to run perpendicular to the channel defined by the plates 110, 115, and 120. In some embodiments, the hat channel 125 may extend from the front plate 115 to the back edge of the top plate 110 where the vertical stopping plate 105 is coupled. In some embodiments, as the one shown in FIG. 1A, the hat channel 125 spans only a partial length from the front plate 105 to the back edge of the top plate. The hat channel 125 may be coupled to the top plate 110, the bottom plate 120, the front plate 115, or a combination thereof. The closure piece may include a plurality of hat channels in some embodiments. The hat channels may be spaced along a length of the channel at regular intervals, for example, two foot intervals. Other spacing intervals may be used. In some embodiments, the hat channels may be spaced at one foot centers. In some embodiments, the hat channels may be spaced at eighteen inch centers. In some embodiments, the spacing intervals between the hat channels may be determined, at least in part, by the spacing intervals of fasteners of a track to be installed.

The embedding material 130 in the hat channel 125 may be adjacent to a bottom surface of the top plate 110. In some embodiments, the embedding material may be foam, fiber board, a polymer material, and/or a composite of a plurality of materials. The embedding material 130 may be able to accept a fastener (not shown in FIG. 1A). For example, the embedding material 130 may be selected such that the embedding material may be able to be fastened into with conventional job site tools, and may hold a fastener.

Figure 1B:
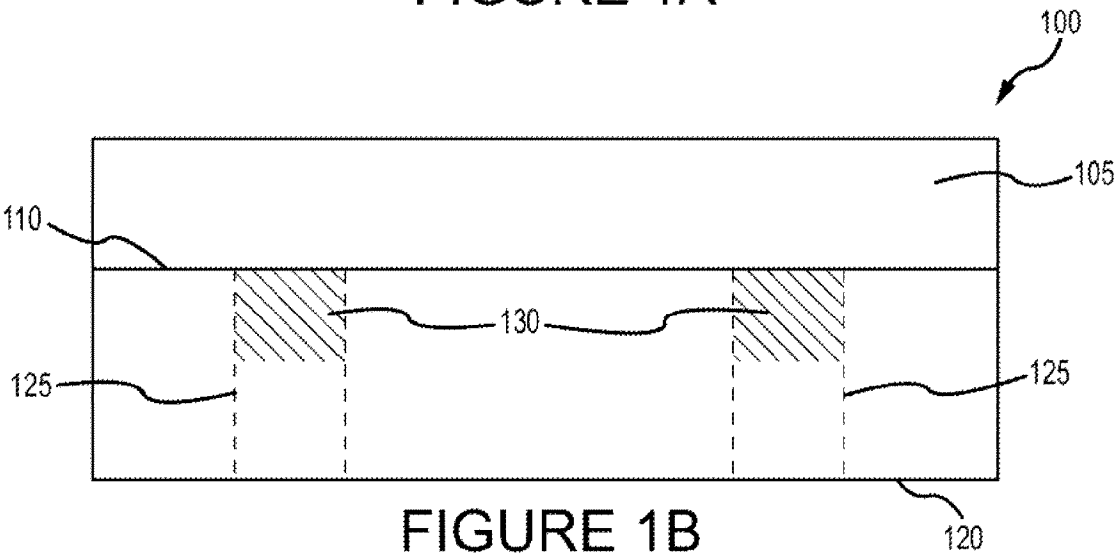
FIG. 1B is a schematic illustration of a front view of the example closure piece.

FIG. 1B shows a schematic illustration of a front view of the example closure piece 100, arranged in accordance with at least some embodiments described herein. FIG. 1B shows a stopping plate 105 coupled to a top plate 110, which is coupled to a front plate 115, and the front plate 115 is coupled to a bottom plate 120. The closure piece 100 further includes two hat channels 125 and embedding materials 130 within the hat channels 125. The various components described in FIG. 1B are merely embodiments, and other variations, including eliminating components, combining components, and substituting components are all contemplated. In some embodiments, the vertical stopping plate 105 may be eliminated. In some embodiments, the hat channels 125 may be eliminated. When the hat channels 125 may be eliminated, the embedding material 130 may extend from the top plate 110 to the bottom plate 120, and may be coupled to the top plate 110 and/or the bottom plate 120.

Figure 1C:
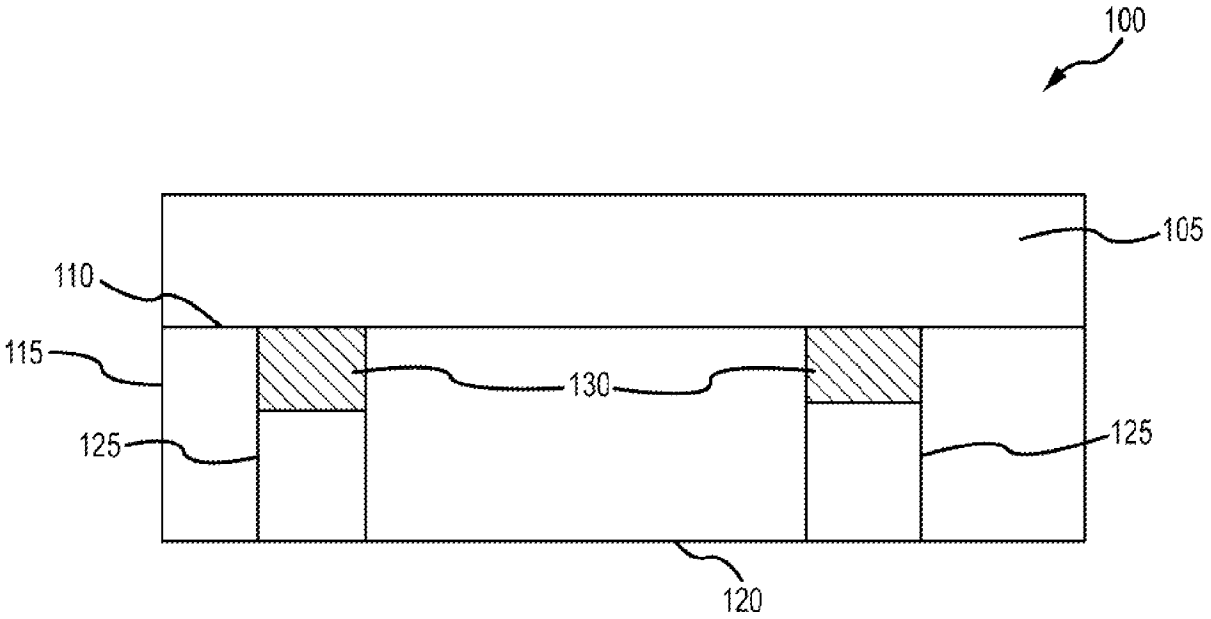
FIG. 1C is a schematic illustration of a back view of the example closure piece.

FIG. 1C shows a schematic illustration of a back view of the example closure piece 100, arranged in accordance with at least some embodiments described herein. FIG. 1C shows a stopping plate 105 coupled to a top plate 110, which is coupled to a front plate 115, and the front plate 115 is coupled to a bottom plate 120. The closure piece 100 further includes two hat channels 125 and embedding materials 130 within the hat channels 125. The various components described in FIG. 1C are merely embodiments, and other variations, including eliminating components, combining components, and substituting components are all contemplated.

Figure 2:
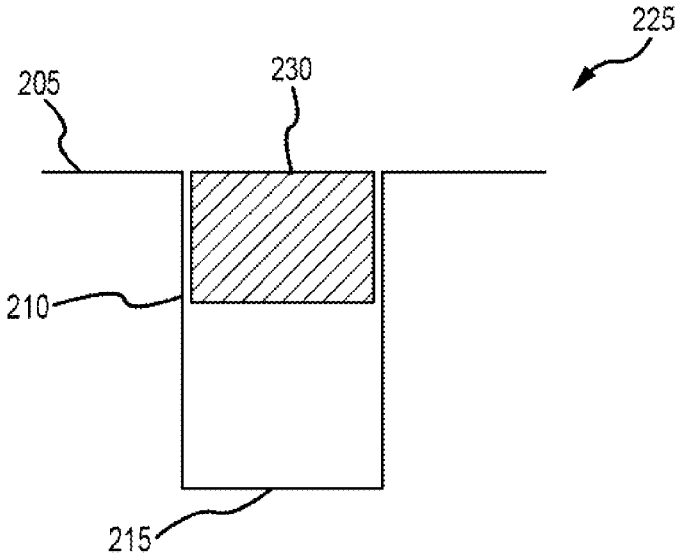
FIG. 2 is a schematic illustration of a back view of an example hat channel.

FIG. 2 shows a schematic illustration of a back view of an example hat channel 225, arranged in accordance with at least some embodiments described herein. The hat channel 225 may have flanges 205 on each side that run the length of the hat channel 225. The flanges 205 may be coupled to the top edges of side plates 210, which are coupled to a base plate 215. The hat channel 225 may also include an embedding material 230 between the side plates 210. The various components described in FIG. 2 are merely embodiments, and other variations, including eliminating components, combining components, and substituting components are all contemplated.

In some embodiments, the flanges 205 and/or the base plate 215 may be used to couple the hat channel 225 to the closure piece 100.

In some embodiments, the embedding material 230 may have a thickness of one inch. In some embodiments, the embedding material 230 may have a thickness of less than one inch. In some embodiments, the embedding material 230 has a thickness of more than one inch. In some embodiments, the embedding material 230 may completely fill the hat channel 225.

Figure 3:
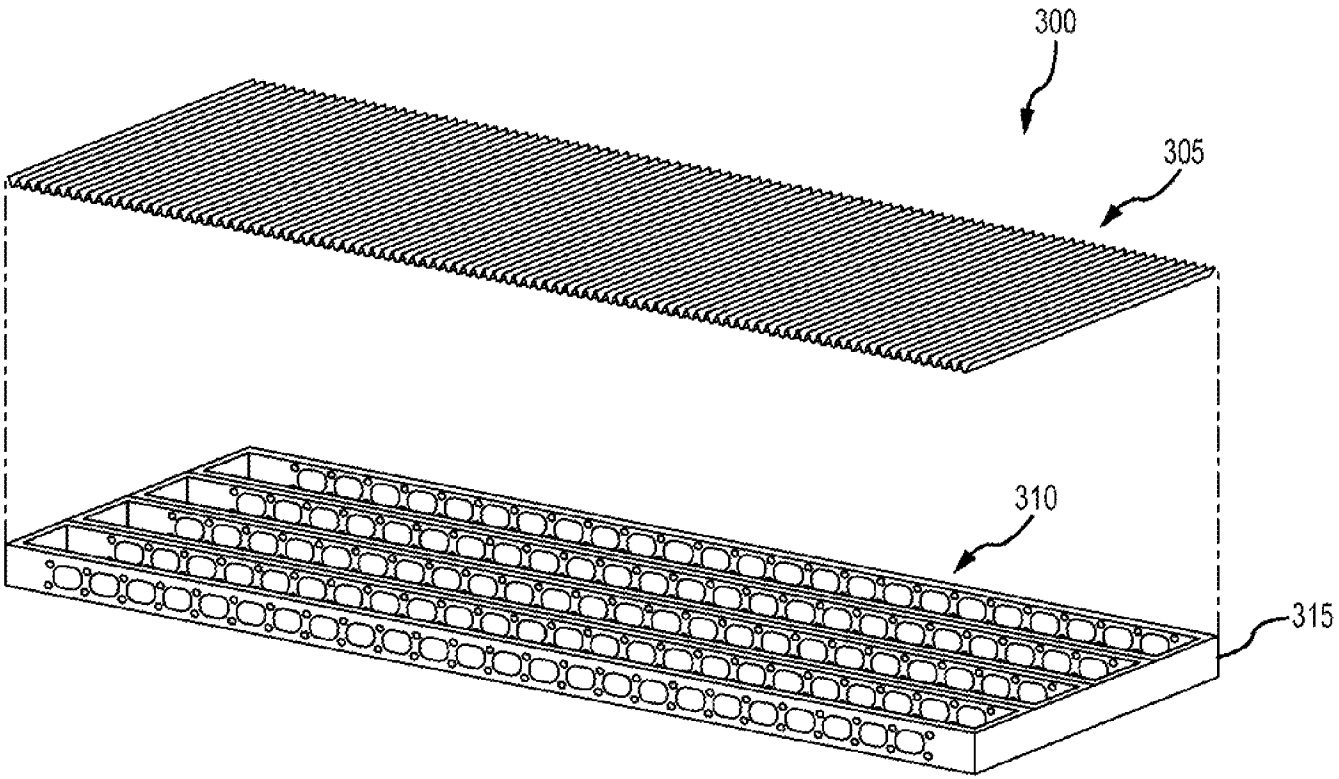
FIG. 3 is a schematic illustration of an example floor panel.

FIG. 3 shows a schematic illustration of an example floor panel 300, arranged in accordance with at least some embodiments described herein. The floor panel 300 includes a deck 305, joists 310, and opposing end members 315. The various components shown in FIG. 3 are merely embodiments, and other variations, including eliminating components, combining components, and substituting components are all contemplated. In some embodiments, floor ceiling sandwich panels may be used.

The plurality of joists 310 and/or opposing end members 315 may form a frame as shown in FIG. 3. The joists 310 may form horizontal supporting members that span the distance between the opposing end members 315 to support a floor. The joists 310 may be oriented generally perpendicular to the end members 315. As used herein, generally perpendicular is used to mean the angle formed between two or more elements is 90 degrees plus or minus up to about 15 degrees. In some embodiments, the end members 315 may not be present. In some embodiments, the frame may be formed of a metallic material, such as aluminum or steel, for fire resistance, structural strength, weight reduction, or other factors. In some embodiments, the joists 310 and/or end members 315 may be formed of wood.

The joists 310 may be spaced apart from one another at regular intervals along the length of the end members 315. For example, the joists 310 may be spaced at two foot centers along the length of the end members 315. The number, dimensions, or both of the joists 310, the end members 315, or both may be varied to suit the parameters of the particular building. In some embodiments, only one joist 310 may be used. In some embodiments, and as shown in FIG. 3, the frame may include five joists 310 and two end members 315. In some embodiments, the frame may have a height of about ten inches, a width of about eight feet, and a length of about twenty-two feet. In some embodiments, the joists 310 have a height of about ten inches and a length of about twenty-two feet. In some embodiments, the end members 315 have a height of about ten inches and a length of about eight feet. In some embodiments, the floor panel 300 may be about two feet wide and twenty two feet long. In some embodiments, the floor panel 300 may be about eight feet wide and twelve feet long. In some embodiments, the floor panel 300 may be coupled to multiple floor panels such that the coupled floor panels are an integrated unit that may perform as a single floor panel. In some embodiments, the floor panel 300 may not be rectangular. In some embodiments, the floor panel 300 may be triangular, wedge shaped, or another shape. The shape of the floor panel 300 may be determined at least in part by the desired floor plan of a building.

The deck 305 may be disposed above and attached to the frame. In some embodiments, and as shown in FIG. 3, the deck 305 may be a corrugated form deck. In some embodiments, the deck 305 may be disposed above and attached to the plurality of joists 310, the end members 315, or both. The deck 305 may form a supporting substrate for a concrete topping slab (not shown in FIG. 3). The deck 305 may extend the entire length and width of the frame to enclose an upper side of the floor panel 300. In some embodiments, the deck 305 may be formed of a metallic material, such as aluminum or steel. In some embodiments, the deck 305 is a 1.5 inch corrugated steel form deck that is fastened, such as screwed, to the top of the frame to form a sub-floor. In some embodiments, the deck 305 may be a plywood panel that may be fastened to the top of the frame to form a sub-floor.

Figure 4:
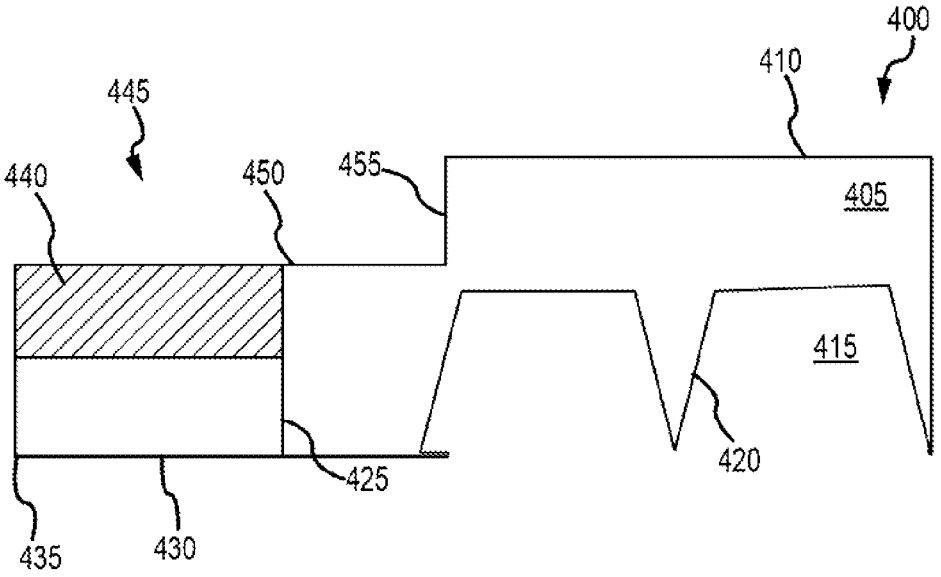
FIG. 4 is a schematic illustration of a side view of an example closure piece coupled to an example floor panel with poured concrete.

FIG. 4 shows a schematic illustration of a side view of the example closure piece 445 coupled to an example floor panel 415 with poured concrete 400, arranged in accordance with at least some embodiments described herein. FIG. 4 shows the closure piece 445 coupled to the floor panel 415. The various components shown in FIG. 4 are merely embodiments, and other variations, including eliminating components, combining components, and substituting components are all contemplated.

The closure piece 445 may span an entire width of the floor panel 415. The closure piece 445 may be coupled to the floor panel 415 by coupling the bottom plate 430 to the deck 420. In some embodiments, the bottom plate 430 may be coupled to the joists (not shown in FIG. 4) of the floor panel 415. In some embodiments, the bottom plate 430 is coupled to at least one of the opposing end members (not shown in FIG. 4). In some embodiments, the bottom plate 430 is between the deck 420 and joists. In some embodiments, the closure piece 445 may be slidably coupled to the floor panel 415 such that it may be retracted and extended. In some embodiments, the closure piece 445 may be coupled to the floor panel 415 before the concrete 400 is poured. The closure piece 445 may be retracted to facilitate positioning of the floor panel 415. Once the floor panel 415 is positioned, the closure piece 445 may be extended as desired. In some embodiments, the closure piece 445 may be extended to a C-channel. Optionally, a thermal break material may be coupled between the C-channel and the closure piece 445 in some embodiments. In some embodiments, the thermal break material may be mineral wool. In some embodiments, the thermal break material is fabric-reinforced resin. In some embodiments, the floor panel 415 is coupled to the C-channel. The C-channel may in turn be used to connect the floor panel 415 to a structural support of a building, such as an exterior steel frame. In some embodiments, the closure piece 445 may be extended to a balcony. Extending the closure piece 445 may span a gap between the floor panel 415 and another structure in some embodiments.

In some embodiments, concrete 400 may be poured over the deck 420. The concrete 400 may flow into the closure piece 445 in some embodiments. In some embodiments, the concrete may partially or completely fill the channel defined by the top, front, and bottom plates 450, 435, 430 and the hat channels 425. In some embodiments, the embedding material 440 may prevent the concrete 400 from filling that portion of the hat channels 425 occupied by the embedding material 440. In some embodiments, the vertical stopping plate 455 may prevent the concrete 400 from flowing onto an upper surface of the top plate 450. The concrete 400 may form a concrete topping slab 405 that may be disposed above the deck 420. The concrete topping slab 405 may form a lightweight concrete finished floor of a unit disposed above the floor panel 415. In some embodiments, concrete topping slab 405 may be troweled to form the finished floor of a building unit. In some embodiments, the upper surface 410 of the finished floor may be level with the top edge of the vertical stopping edge 455.

In some embodiments, the concrete 400 may be replaced by fiberglass insulation. In some embodiments, an expandable foam insulation may be installed over the decking 420 that may also expand into the closure piece. In some embodiments, the decking 420 may be plywood, and the concrete 400 may be replaced with foam insulation panels and carpeting.

Figure 5A:
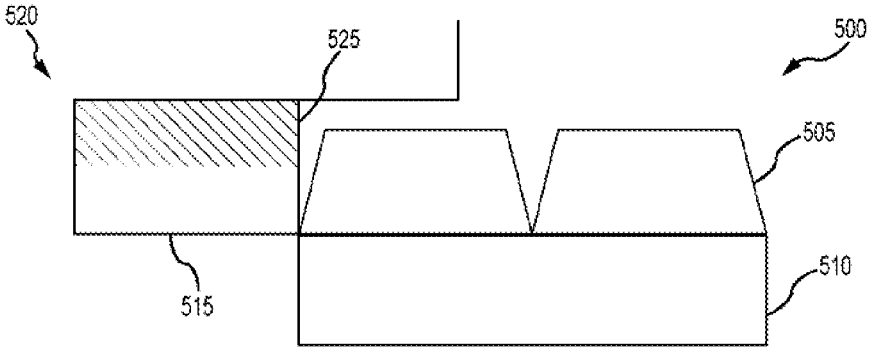
FIG. 5A is a schematic illustration of a side view of the example closure piece in a retracted position coupled between an example decking and an example joist of an example floor panel.

FIG. 5A is a schematic illustration of a side view of the example closure piece 520 in a retracted position coupled between an example decking 505 and an example joist 510 of an example floor panel 500. The various components shown in FIG. 5A are merely embodiments, and other variations, including eliminating components, combining components, and substituting components are all contemplated.

Figure 5B:
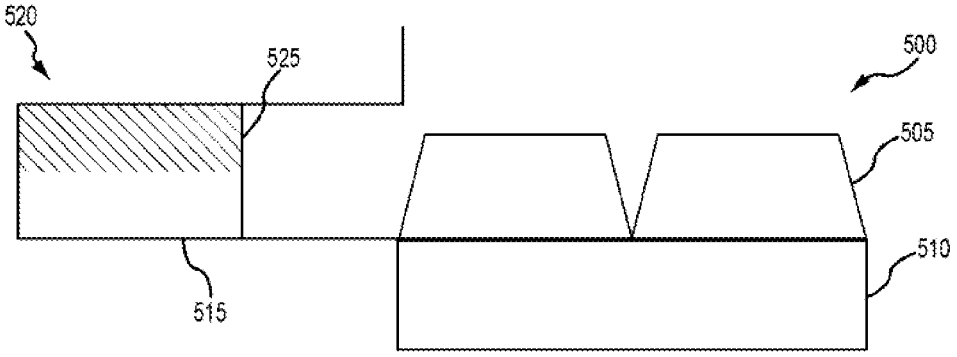
FIG. 5B is a schematic illustration of a side view of the example closure piece in an extended position coupled between an example decking and an example joist of an example floor panel.

FIG. 5B is a schematic illustration of a side view of the example closure piece 520 in an extended position coupled between an example decking 505 and an example joist 510 of an example floor panel 500. The various components shown in FIG. 5B are merely embodiments, and other variations, including eliminating components, combining components, and substituting components are all contemplated.

In some embodiments, the extended position may be limited by the length of the bottom plate 515 of the closure piece 520. In some embodiments, the retracted position may be limited by the decking 505 contacting a hat channel 525 in the closure piece 520. In some embodiments, the closure piece 520 may move between the extended and retracted positions freely until concrete is poured. In some embodiments, the closure piece 520 may move between the extended and retracted positions freely until fasteners (not shown) coupling the closure piece 520 to the floor panel 500 are secured. In some embodiments, the bottom plate 515 of the closure piece 520 is wedged between the decking 505 and joists 510 such that the closure piece 520 is coupled to the floor panel 505 by friction.

Figure 6:
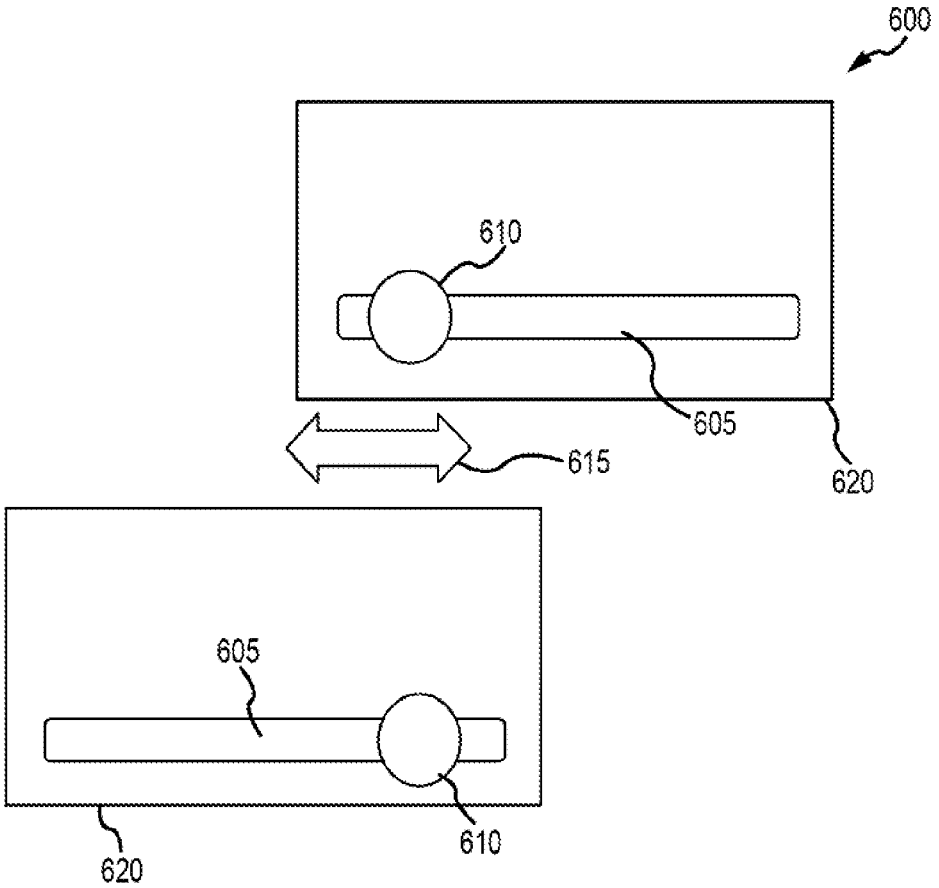
FIG. 6 is a schematic illustration of a top view of an example slidable connection.

FIG. 6 shows a schematic illustration of a top view of an example slidable connection 600, arranged in accordance with at least some embodiments described herein. FIG. 6 shows a portion of a bottom plate 620 of a closure piece. Additional elements of the closure piece have been omitted for clarity. The bottom plate 620 includes an opening 605 with a fastener 610 that may partially pass through the opening 605. The bottom plate 620 may be moved in direction 615 along the length of the opening 605. The various components shown in FIG. 6 are merely embodiments, and other variations, including eliminating components, combining components, and substituting components are all contemplated In some embodiments, the bottom plate 120 of the closure piece may have long, narrow, rectangular openings 605 in the bottom plate 120 as illustrated in FIG. 6. The closure piece may be coupled to a joist (not shown) by the fastener 610. In some embodiments, the fastener 610 may be a bolt. The bolt may be narrow enough to pass through the opening 605 in the bottom plate 620. However, the bolt may have a head that is wider than the opening 605 in the bottom plate 620, as illustrated in FIG. 6. This may prevent the bolt head from passing through the opening 605 in the bottom plate 620. This may restrict the movement of the bottom plate 620 to sliding along direction 615. In some embodiments, the slidable connection 600 may be eliminated by tightening the fastener 610 such that the bottom plate 620 is held against the joist.

Figure 7:
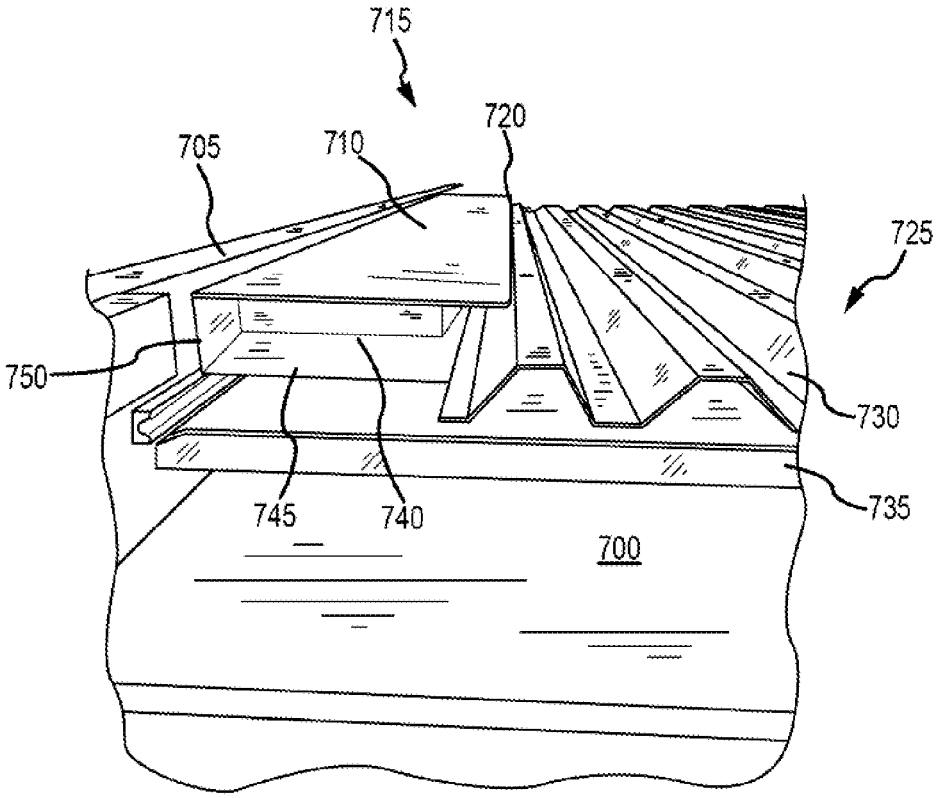
FIG. 7 is a schematic illustration of an example closure piece coupled to an example floor panel.

FIG. 7 shows a schematic illustration of an example closure piece 715 coupled to an example floor panel 725, arranged in accordance with at least some embodiments described herein. FIG. 7 shows a closure piece 715 coupled to a floor panel 725, which is coupled to a steel structure 700. The closure piece 715 may be coupled to the floor panel 725 by a bottom plate 745 coupled between a joist 735 and a decking 730 of the floor panel 725. The closure piece 715 may include a hat channel 740. The floor panel 725 may be coupled to a C-channel 705, and the closure piece 715 extended from the floor panel 725 such that the front plate 750 is adjacent to the C-channel 705. The top plate 710 extends from the C-channel 705 to the vertical stopping plate 720. The various components shown in FIG. 7 are merely embodiments, and other variations, including eliminating components, combining components, and substituting components are all contemplated.

In some embodiments the closure piece 715 extends for the entire width of the floor panel 725. In some embodiments, the closure piece 715 extends for the width of multiple floor panels 725. In some embodiments, the closure piece 715 may span for only a portion of the width of the floor panel 725. In some embodiments, the length of the closure piece 715 may be determined, at least in part, by the length of a track to be installed.

Figure 8:
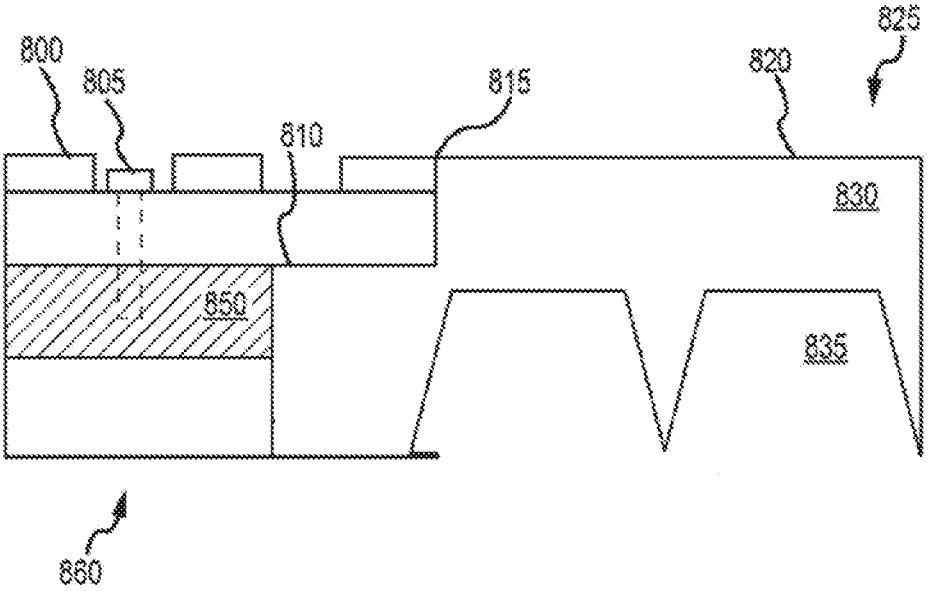
FIG. 8 is a schematic illustration of a side view of the example closure piece coupled to the example floor panel with poured concrete with an example track coupled to the closure piece.

FIG. 8 is a schematic illustration of a side view of the example closure piece 860 coupled to the example floor panel 835 with poured concrete 825 with an example track 800 coupled to the closure piece 860 arranged in accordance with at least some embodiments described herein. FIG. 8 shows the example track 800 coupled to the top plate 810 of the closure piece 860 by a fastener 805. The various components shown in FIG. 8 are merely embodiments, and other variations, including eliminating components, combining components, and substituting components are all contemplated.

The track 800 may be implemented using a metallic material such as steel or aluminum. In some embodiments, the track 800 may be implemented using a polymeric material. In some embodiments, the track 800 may be implemented using wood. The track 800 may facilitate alignment and movement of panels (not shown) within the track 800. In some embodiments, the panels may be movable elements of a wall or door. The panels may include glass panes, plastic sheets, and/or a combination of elements. In some embodiments, a number of the panels are made of a first material and the remaining panels are made of a second material. In some embodiments, the track 800 may span the entire length of the closure piece 860. In some embodiments, the track 800 may be adjacent to the vertical stopping edge 815. In some embodiments, the top of the track 800 may be flush with the upper surface 820 of the finished floor 830. In some embodiments, the top of the track 800 may be flush with an upper surface of a balcony, patio, and/or other exterior surface. In some embodiments, the top of the track 800 may be flush with both the interior floor and the exterior surface. This may allow the transition between the interior and exterior across the track 800 easier to navigate by a wheelchair and/or persons with disabilities.

The embedding material 850 may facilitate the coupling of the track 800 to the top plate 810 without drilling through concrete 825. Generally, in other embodiments, the embedding material 850 may facilitate the fastening of any of a variety of building components to a concrete surface without drilling through concrete. Those building components may include, for example, but are not limited to, tracks, railing materials, window walls, decorative pieces, or combinations thereof. The embedding material 850 may allow the fastener 805 to be securely embedded. The fastener 805 may be a self-tapping screw in some embodiments. Other fastener types may be used in some embodiments. In some embodiments, multiple fasteners 805 may be used to couple the track 805 to the closing piece 860.

Figure 9:
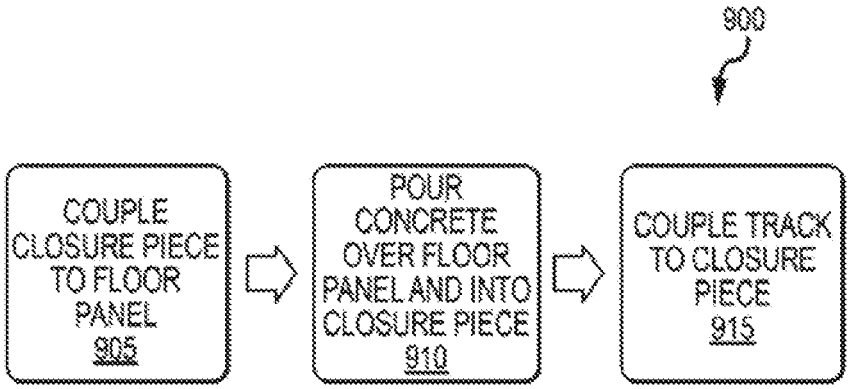
FIG. 9 is a flowchart illustrating an example method.

FIG. 9 is a flowchart illustrating an example method 900. An example method may include one or more operations, functions or actions as illustrated by one or more of blocks 905, 910, and 915.

An example process may begin with block 905, which recites "couple closure piece to floor panel" Block 905 may be followed by block 910, which recites "pour concrete over floor panel and into closure piece." Block 910 may be followed by block 915, which recites, "couple track to closure piece."

The blocks included in the described example methods are for illustration purposes. In some embodiments, the blocks may be performed in a different order. In some other embodiments, various blocks may be eliminated. In still other embodiments, various blocks may be divided into additional blocks, supplemented with other blocks, or combined together into fewer blocks. Other variations of these specific blocks are contemplated, including changes in the order of the blocks, changes in the content of the blocks being split or combined into other blocks, etc. In some embodiments, the closure piece may be movably coupled to the floor panel and the position of the closure piece may be adjusted before the concrete is poured. In some embodiments, the position of the closure piece may be adjusted after the concrete is poured before the concrete has cured.

Block 905 recites, "couple closure piece to floor panel." The closure piece may be coupled to the floor panel by a bottom plate of the closure piece. The bottom plate may include openings to accept fasteners for coupling to the floor panel. In some embodiments, the fasteners may be configured to allow for movement of the closure piece along a path defined by the openings to allow the closure piece to be slidably coupled to the floor panel. In some embodiments, the method 900 may further include retracting and extending the closure piece into desired positions. In some embodiments, the closure piece may be welded to the floor panel. In some embodiments, the closure piece may be bolted to the floor panel.

Block 910 recites, "pour concrete over floor panel and into closure piece." Concrete may be poured over the floor panel to form a finished floor. The concrete may be poured over a deck of the floor panel. The concrete may be allowed to flow into the closure piece. The concrete may partially or fully fill the closure piece. In some embodiments, the closure piece includes a vertical stopping edge to prevent the concrete from flowing over the top of the closure piece. The vertical stopping edge may define an edge of the finished floor.

Block 915 recites, "couple track to closure piece." The track may be coupled to an upper surface of the closure piece. The track may be secured by fasteners that are at least partially embedded in a embedding material in the closure piece. The embedding material may allow fasteners that cannot permeate concrete to be used to couple the track to the closure piece. In some embodiments, the track may be coupled to the closure piece after the concrete has cured. In some embodiments, the track may be coupled to the closure piece before the concrete has cured. In some embodiments, the track may be coupled to the closure piece before the concrete has been poured.

In some embodiments, a pre-assembled floor and ceiling panel may be obtained. In some embodiments, the floor and ceiling panel may have been assembled at a different location than the building site, however it may in some embodiments be assembled at the building site. In some embodiments, the pre-assembled panel may include the closure piece. In some embodiments, the closure piece is coupled to the floor and ceiling panel at a later point in time. The panels may include a plurality of joists and a corrugated form deck disposed above and attached to the plurality of joists. In some embodiments, the closure piece is coupled to the deck. In some embodiments, the closure piece is coupled to one or more of the joists. In some embodiments, the closure piece is coupled to both the deck and the joists.

The floor and ceiling panel may be attached to the frame of a building. For example, the floor and ceiling panel may be attached to an exterior steel structure, which may provide the structural support for a building. Generally, any mechanism may be used to attach the floor and ceiling panel, or multiple floor and ceiling panels, to the frame of the building, such as an external steel structure. Any type of fastening may generally be used.

Concrete may be poured onto the floor and ceiling panel and into the closure piece. As described herein, pouring the concrete may form a diaphragm of the building, which may span an entire story of the building in some embodiments. In this manner, the concrete may be poured at the completed height of the story of the building, after the floor and ceiling panels and closure pieces have been positioned at the desired story, thereby forming the floor of units in that story. In some embodiments, tracks for sliding panels may be coupled to the closure pieces. In some embodiments, panels may then be installed in the tracks. The panels may be elements of doors, walls, and/or windows. The panels may be made of opaque or transparent materials. The closure pieces and tracks may provide a suitable transition between the interior and exterior of the structure. In some embodiments, the exterior may include a balcony and/or patio.

Embodiments of pre-assembled floor and ceiling panels may provide a floor and ceiling system useable in mid-rise and high-rise residential projects, among others. The panels with the closure pieces and tracks installed may be configured to comply with one or more of the following building codes: fire, energy, handicap, life-safety, and acoustical (impact and ambient noise transfer). In some embodiments, the pre-assembled floor and ceiling panels with the closure pieces and tracks may be considered as a fully-integrated sub-assembly meeting fire, sound impact, energy, and life/safety codes. The floor and ceiling panels may be fully integrated with electrical, fire protection, energy insulation, and sound isolation capabilities in some embodiments. The floor and ceiling panels may be designed to achieve a fire rating set by the applicable building code, such as a two-hour fire rating.

The floor and ceiling panels and closure pieces described herein may be fabricated off-site in a factory or shop and transported to the project jobsite for attachment to a structural frame, such as a structural exoskeleton, of a building. The panels and closure pieces may be fabricated in various sizes, such as eight feet by twenty-two feet. Smaller infill panels may be prefabricated on a project-by-project basis to complete the building floor system. At the building site, the panel may be attached to end walls, demising walls, utility walls, building utilities, or any combination thereof. The floor and ceiling panel may provide support the overall floor system, which may include a concrete topping slab poured in the field to create a structural diaphragm for the building.

Example I

In a first non-limiting example, an eight foot long 18 gauge cold-rolled steel closure piece may be coupled to an eight foot wide floor panel. The closure piece may include 18 gauge cold-rolled steel hat channels installed at two-foot centers. The hat channels may include a one inch thick expanded polystyrene foam strip extending the length of the hat channel adjacent to the bottom surface of a top plate of the closure piece. The floor panel may include a light gauge steel frame and a plurality of light gauge punched steel joists. The joists may be spaced at two foot centers. The frame and joists may be eight inches deep. The frame and joists may be twenty two feet long. A corrugated steel decking may be bolted to the frame and joists to form an upper surface of the floor panel. The closure piece may be coupled to the floor panel by wedging a bottom plate of the closure piece between the decking and the joists. Lightweight concrete may be poured over the floor panel to form a floor slab. The concrete may also pour into the closure piece and substantially fill the closure piece. The concrete may be troweled to be even with the top edge of a vertical stopping plate of the closure piece. The concrete may then be allowed to cure. An anodized aluminum window wall track may be installed on the top plate of the closure piece. Self-tapping screws may pass through the aluminum window track and may be partially embedded in the expanded polystyrene foam strips in the hat channels.

Example II

In a second non-limiting example, an eight foot long plywood form closure piece may be coupled to an eight foot wide floor panel. The closure piece may include wood strips defining narrow cavities perpendicular to the length of the closure piece at two-foot centers. The narrow cavities may include a one inch thick fiber cement board strip extending the length of the narrow cavities adjacent to the bottom surface of a top board of the closure piece. The floor panel may include a wood frame and a plurality of wooden joists. The joists may be spaced at sixteen inch centers. The frame and joists may be twelve feet long. A plywood decking may be screwed to the frame and joists to form an upper surface of the floor panel. The closure piece may be coupled to the floor panel by wedging a bottom board of the closure piece between the decking and the joists. Lightweight concrete may be poured over the floor panel to form a floor slab. The concrete may also pour into the closure piece and substantially fill the closure piece. The concrete may be troweled to be even with the top edge of a vertical stopping board of the closure piece. The concrete may then be allowed to cure. A wooden rice paper panel track may be installed on the top board of the closure piece. Screws may pass through the wooden rice paper panel track and may be partially embedded in the fiber cement board strips in the narrow cavities.

Example III

In a third non-limiting example, an eight foot long plywood form closure piece may be coupled to an eight foot wide floor panel. The closure piece may include elongated wood blocks perpendicular to the length of the closure piece at two-foot centers. The floor panel may include a wood frame and a plurality of wooden joists. The joists may be spaced at sixteen inch centers. The frame and joists may be twelve feet long. The closure piece may be coupled to the floor panel by screwing a bottom board of the closure piece to the joists. Expandable foam may be introduced between the joists and may expand into the closure piece and substantially fill the closure piece. The foam may cure, and a layer of plywood may be installed over the foam. Padding and carpeting may be installed over the plywood to form an upper surface of the floor panel. An aluminum window wall panel track may be installed on the top board of the closure piece. Screws may pass through the window wall panel track and may be partially embedded in elongated wooden blocks.

The examples provided are for explanatory purposes only and should not be considered to limit the scope of the disclosure. Each example embodiment may be practical for a particular environment such as urban mixed-use developments, low-rise residential units, and/or remote communities. Materials and dimensions for individual elements may be configured to comply with one or more of the following building codes: fire, energy, handicap, life-safety, and acoustical (impact and ambient noise transfer) without departing from the scope of the principles of the disclosure. The elements and/or system may also be configured to comply with social and/or religious codes as desired. For example, materials, systems, methods, and/or apparatuses may be configured to comply with the International Building Code as it has been adopted in a jurisdiction.

The present disclosure is not to be limited in terms of the particular examples described in this application, which are intended as illustrations of various aspects. Many modifications and examples can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and examples are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular examples only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to examples containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations).

Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 items refers to groups having 1, 2, or 3 items. Similarly, a group having 1-5 items refers to groups having 1, 2, 3, 4, or 5 items, and so forth.

The herein described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

While various aspects and examples have been disclosed herein, other aspects and examples will be apparent to those skilled in the art. The various aspects and examples disclosed herein are for purposes of illustration and are not intended to be limiting, with the true scope and spirit being indicated by the following claims.

What is claimed is:

1. An apparatus to create an interface between a floor panel and a track, the apparatus comprising:

a bottom plate;

a front plate coupled along a bottom edge of the front plate to a front edge of the bottom plate;

a top plate coupled along a front edge of the top plate to a top edge of the front plate such that a channel having a length is formed between the bottom plate and the top plate;

a vertical stopping plate coupled along a lower edge of the vertical stopping plate to a back edge of the top plate, wherein the vertical stopping plate extends upwards in a direction away from the bottom plate;

a hat channel having a length and coupled to an inner surface of the channel, wherein the length of the hat channel is perpendicular to the length of the channel;

an embedding material inside the hat channel, wherein the embedding material is adjacent to a bottom surface of the top plate; and the track coupled to the top plate by a fastener at least partially embedded in the embedding material.

2. The apparatus of claim 1, wherein the embedding material comprises foam.

3. The apparatus of claim 2, wherein the foam has a thickness of one inch.

4. The apparatus of claim 1, wherein the bottom plate is coupled to the front plate at a right angle, and wherein the front plate is coupled to the top plate at a right angle.

5. The apparatus of claim 1, further comprising a plurality of hat channels that include the hat channel, wherein the plurality of hat channels are coupled to the inner surface of the channel.

6. The apparatus of claim 5, wherein the plurality of hat channels are spaced at two foot intervals along the length of the channel.

7. The apparatus of claim 1, wherein the bottom plate further comprises openings configured to couple the bottom plate to the floor panel.

8. The apparatus of claim 1, wherein the vertical stopping plate has a height that extends above the top plate.

9. A system to create an interface between a floor panel and a track, the system comprising:

the floor panel, wherein the floor panel includes:

at least one joist; and a deck, wherein the deck forms an upper surface of the floor panel;

a closure piece having a length and coupled to the floor panel, wherein the closure piece includes:

a bottom plate;

a front plate coupled along a bottom edge of the front plate to a front edge of the bottom plate;

a top plate coupled along a front edge of the top plate to a top edge of the front plate;

a vertical stopping plate coupled along a lower edge of the vertical stopping plate to a back edge of the top plate, wherein the vertical stopping plate extends upwards in a direction away from the bottom plate;

a hat channel having a length and formed between the top plate and the bottom plate, wherein the length of the hat channel is perpendicular to the length of the closure piece; and an embedding material inside the hat channel, wherein the embedding material is adjacent to a bottom surface of the top plate; and the track coupled to an upper surface of the top plate of the closure piece by a fastener at least partially embedded in the embedding material.

10. The system of claim 9, further comprising a concrete floor poured over the deck of the floor panel and between the top plate and bottom plate of the closure piece.

11. The system of claim 10, wherein the concrete floor is level with an upper edge of the vertical stopping plate.

12. The system of claim 9, further comprising a balcony adjacent to the front plate of the closure piece.

13. The system of claim 9, wherein the closure piece is coupled to the floor panel, and wherein the bottom plate is between the at least one joist and the deck.

14. The system of claim 9, wherein the closure piece is slidably coupled to the floor panel.

* * * * *